US007100918B1

(12) United States Patent
Selsky-Quezada

(10) Patent No.: US 7,100,918 B1
(45) Date of Patent: Sep. 5, 2006

(54) BOARD GAME KIT AND METHOD OF USING

(76) Inventor: Anita M Selsky-Quezada, 3503 Allendale Dr., Holiday, FL (US) 34691

( * ) Notice: Subject to any disclaimer, the term of this patent is extended or adjusted under 35 U.S.C. 154(b) by 0 days.

(21) Appl. No.: 10/841,322

(22) Filed: Aug. 3, 2004

(51) Int. Cl.
*A63F 3/00* (2006.01)

(52) U.S. Cl. ..... 273/260; 273/261

(58) Field of Classification Search ..... 273/260, 273/261
See application file for complete search history.

(56) References Cited

U.S. PATENT DOCUMENTS 1,102,594 A * 7/1914 Kiefer ..... 273/260
3,191,184 A * 6/1965 Durstewitz ..... 273/249
3,602,512 A 8/1971 Krugler
4,961,583 A * 10/1990 Koch et al. ..... 273/260
5,197,742 A * 3/1993 Bendit ..... 273/239
5,692,752 A * 12/1997 Hanna ..... 273/248
5,893,561 A 4/1999 Hoffman
5,899,456 A 5/1999 Weinstock

* cited by examiner

*Primary Examiner*—Vishu Mendiratta

(57) ABSTRACT

A new and improved game kit and associated methods of using are disclosed for use in learning facts about art subjects. The game kit comprises a bucket; a pail; question tabs; bonus tabs; reference cards; a first set of play pieces; a second set of play pieces; a collection of first award tokens; a collection of second award tokens; and a checkerboard design like game board. The checkerboard design like game board has a generally square shape and a playing facade 30, in which the playing facade comprising a plurality of alternately spaced dark and light squares. Each dark square has a unique art image affixed on each corresponding dark square of the plurality of dark squares. The method of using comprises the steps of adding, agreeing, attaching, depositing, enlisting, inserting, letting, obtaining, placing, positioning, putting, resolving, mixing, sitting, unfolding, and volunteering.

2 Claims, 4 Drawing Sheets

BOARD GAME KIT AND METHOD OF USING

FIELD OF THE INVENTION

The present invention relates to games, more particularly to a game kit having a plurality of game pieces, tabs to be played on a game board for use in learning various facts concerning art.

DESCRIPTION OF THE PRIOR ART

Board games have been a popular source of entertainment and education for decades. Hundreds of board games have been created to teach spelling, grammar, vocabulary, math and other such skills, while providing a learning medium that is both entertaining and interesting. With such games, players, especially children, tend to learn information more quickly and retain that information longer, than the traditional classroom approach to learning.

Many traditional board games exist that, require players to move around and across a game board as directed by a random number generator, such as a roll of a die or a spin on a wheel. In such traditional games, the goal is often to acquire, or spend as much as possible. Still other traditional games are trivia based and winning is determined by the first person to cross a finish line by correctly answering questions. Although games exist that combine the two types of traditional board games, no such game exist that combine these traditional game elements in such a way as to show the physical layout or foster the learning effect of the present invention. A wide variety of board games is currently available on the commercial market and an even larger number of these types of devices are known in the art of board games, for example, the board game apparatus disclosed by Krugler in U.S. Pat. No. 3,602,512; the game to test players' knowledge of rock and roll songs disclosed by Sowek in U.S. Pat. No. 5,433,499; the music trivia game disclosed by Hoffman in U.S. Pat. No. 5,893,561; the progressive trivia game disclosed by Weinstock et al. in U.S. Pat. No. 5,899,456; the chessboard or similar article disclosed by Danon in U.S. Pat. No. D111,848; and the game playing board disclosed by Knight in U.S. Pat. No. D360,234.

While all of the above-described devices fulfill their respective, particular objectives and requirements, the aforementioned patents do not describe a Even still another object of the present invention is to provide a game kit for having a bucket; a pail; question tabs; bonus tabs; reference cards; a first set of play pieces; a second set of play pieces; a collection of first award tokens; a collection of second award tokens; and a checkerboard design like game board having a generally square shape and a playing facade 30, in which the playing facade comprising a plurality of alternately spaced dark and light squares wherein each dark square having a unique art image affixed on each corresponding dark square of the plurality of dark squares. This combination of elements would specifically match the user's particular individual needs by making it possible to allow players to readily learn facts about various art subjects. The above-described patents make no provision for a game kit for having a bucket; a pail; question tabs; bonus tabs; reference cards; a first set of play pieces; a second set of play pieces; a collection of first award tokens; a collection of second award tokens; and a checkerboard design like game board having a generally square shape and a playing facade 30, in which the playing facade comprising a plurality of alternately spaced dark and light squares wherein each dark square having a unique art image affixed on each corresponding dark square of the plurality of dark squares.

Therefore, a need exists for a new and improved game kit having a bucket; a pail; question tabs; bonus tabs; reference cards; bonus cards; a first set of play pieces; a second set of play pieces; a collection of first award tokens; a collection of second award tokens; and a checkerboard design like game board having a generally square shape and a playing facade 30, in which the playing facade comprising a plurality of alternately spaced dark and light squares wherein each dark square having a unique art image affixed on each corresponding dark square of the plurality of dark squares. In this respect, the game kit according to the present invention substantially departs from the conventional concepts and designs of the prior art, and in doing so provides an apparatus primarily developed for the purpose of making it possible to allow players to readily learn facts about various art subjects.

SUMMARY OF THE INVENTION

The present kit and method, according to the principles of the present invention, overcomes the shortcomings of the prior art by providing new and improved game kit and associated method for use in learning facts about art subjects. The game kit comprises a bucket; a pail; question tabs; bonus tabs; reference cards; bonus cards; a first set of play pieces; a second set of play pieces; a collection of first award tokens; a collection of second award tokens; and a checkerboard design like game board. The checkerboard design like game board has a generally square shape and a playing facade 30, in which the playing facade comprising a plurality of alternately spaced dark and light squares. Each dark square has a unique art image affixed on each corresponding dark square of the plurality of dark squares. The method of using comprises the steps of adding, agreeing, attaching, depositing, enlisting, inserting, letting, obtaining, placing, positioning, putting, resolving, mixing, sitting, unfolding, and volunteering.

In view of the foregoing disadvantages inherent in the known type game kits now present in the prior art, the present invention provides an improved game kit, which will be described subsequently in great detail, is to provide a new and improved game kit which is not anticipated, rendered obvious, suggested, or even implied by the prior art, either alone or in any combination thereof.

To attain this, the present invention essentially comprises a bucket; a pail; question tabs; bonus tabs; reference cards; bonus cards; a first set of play pieces; a second set of play pieces; a collection of first award tokens; a collection of second award tokens; and a checkerboard design like game board. The checkerboard design like game board has a generally square shape and a playing facade 30, in which the playing facade comprising a plurality of alternately spaced dark and light squares. Each dark square has a unique art image affixed on each corresponding dark square of the plurality of dark squares.

There has thus been outlined, rather broadly, the more important features of the invention in order that the detailed description thereof that follows may be better understood, and in order that the present contribution of the art may be better appreciated.

The invention may also include a rotating base. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game kit that has all the advantages of the prior art game kit and none of the disadvantages.

It is another object of the present invention to provide a new and improved game kit that may be easily and efficiently manufactured and marketed.

An even further object of the present invention is to provide a new and improved game kit that has a low cost of manufacture with regard to both materials and labor, and which accordingly is then susceptible of low prices of sale to the consuming public, thereby making such multipurpose storage unit and system economically available to the buying public.

Still another object of the present invention is to provide a new game kit that provides in the apparatuses and methods of the prior art some of the advantages thererof, while simultaneously overcoming some of the disadvantages normally associated therewith.

Even still another object of the present invention is to provide a game kit for having a bucket; a pail; question tabs; bonus tabs; reference cards; a first set of play pieces; a second set of play pieces; a collection of first award tokens; a collection of second award tokens; and a checkerboard design like game board having a generally square shape and a playing facade 30, in which the playing facade comprising a plurality of alternately spaced dark and light squares wherein each dark square having a unique art image affixed on each corresponding dark square of the plurality of dark squares. This combination of elements makes it possible to allow players to readily learn facts about art subjects, Lastly, it is an object of the present invention to provide a new and improved method of using comprises the steps of adding, agreeing, attaching, depositing, enlisting, inserting, letting, obtaining, placing, positioning, putting, resolving, mixing, sitting, unfolding, and volunteering.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
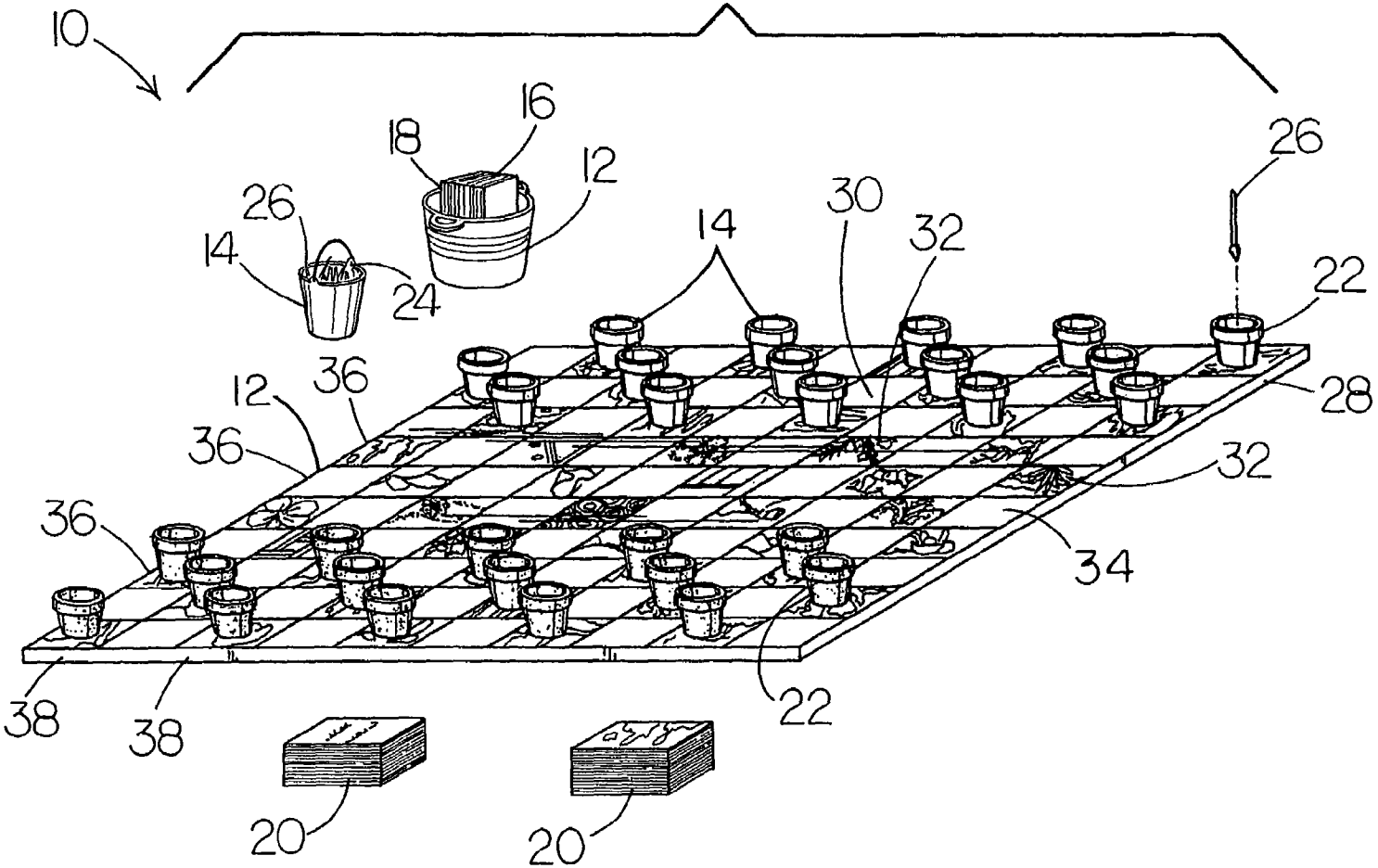
FIG. 1 is a perspective view of a preferred embodiment of the game kit constructed in accordance with the principles of the present invention.
Figure 2:
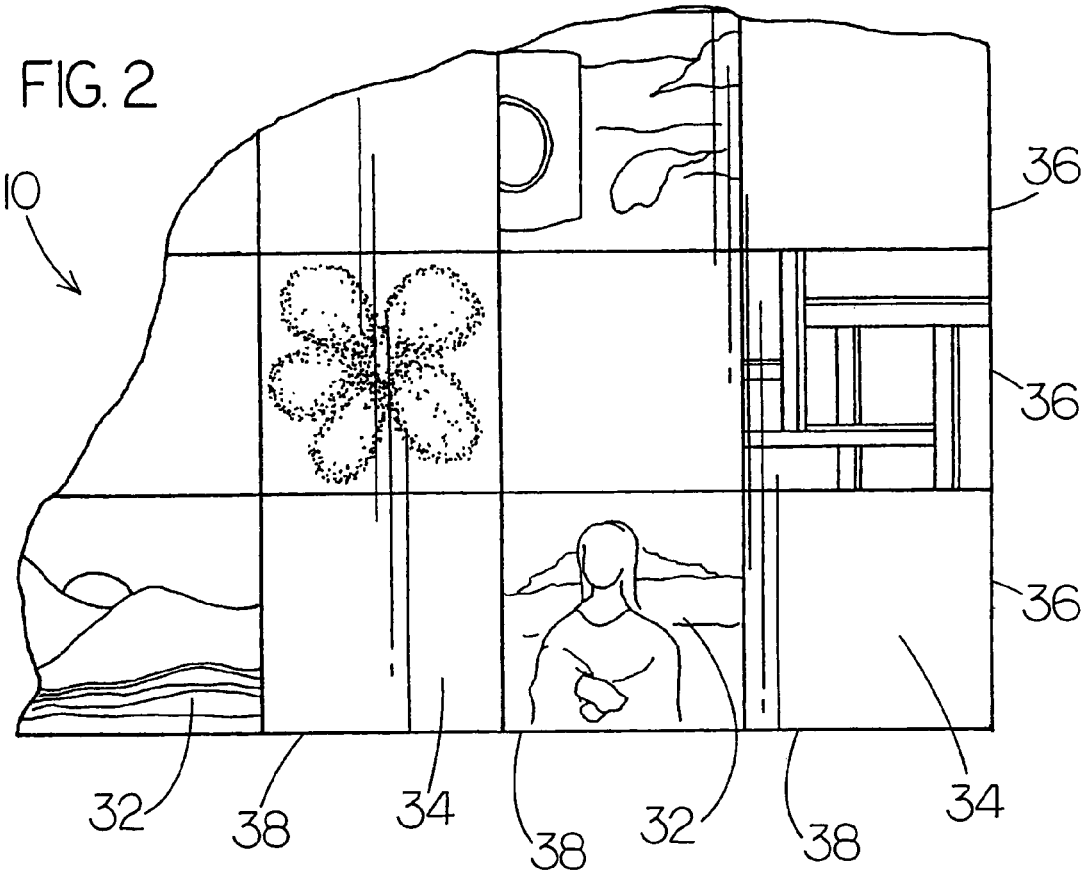
FIG. 2 is a closeup view of a section of a facade of the game board of preferred embodiment of the game kit of the present invention.

Referring now to the drawings, and in particular FIGS. 1 to 2 thereof, one preferred embodiment of the present invention is shown and generally designated by the reference numeral 10. One preferred embodiment of a game kit 10 for learning facts about art subjects, the game kit 10 comprising: a bucket 12; a pail 14; a plurality of question tabs 16; a plurality of bonus tabs 18; a deck of reference cards 20, which includes both regular reference cards and a plurality of bonus cards; a first set of play pieces 22; a second set of play pieces 22; a collection of first award tokens 24; a collection of second award tokens 26; and a checkerboard design like game board 28. The checkerboard design like game board 28 having a generally square shape and a playing facade 30, in which the playing facade 30 of the game board 28 comprising a plurality of dark squares 32 and a plurality of light squares 34. The playing facade 30 of the game board 28 comprises a plurality of rows 36 in which each row 36 of the plurality of rows 36 is composed of alternating dark and light squares (32 and 34) of the plurality of dark squares 32 and the plurality of light squares 34, respectively. The playing facade 30 of the game board 28 comprises a plurality of columns 38 in which each column 38 of the plurality of columns 38 is composed of alternating dark and light squares (32 and 34, respectively) of the plurality of dark squares 32 and the plurality of light squares 34, respectively. The playing facade 30 of the game board 28 having at least eight rows 36 and eight columns 38. In the current embodiment, the board has ten rows 36 and ten columns 38. Each dark square 32 of the plurality of dark squares 32 having a unique art image affixed on each corresponding dark square 32 of the plurality of dark squares 32.

The game board 28 may be made of any material and may also be foldable. The playing facade 30 of the game board 28 may comprises any number of rows 36 and any number of columns. One preferred configuration of the playing facade 30 of the game board 28 comprises ten rows 36 and ten columns 38.

Each question tab 16 of the plurality of question tabs 16 has a unique question printed on it. Each question tab 16 of the plurality of question tabs 16 may have lettering in a dark coloration. Each bonus tab 18 of the plurality of bonus tabs 18 has a unique query printed on it. It is contemplated that the bonus questions given on the bonus tabs 18 will be generally more difficult than the regular questions found on the question tabs 16. Each bonus tab 18 of the plurality of bonus tabs 18 may have lettering in a red coloration to distinguish the question as a bonus.

Each reference card 20 of the reference cards 20 has a unique answer printed on it, wherein the unique answer printed on the each corresponding reference card 20 of the reference cards 20 is associated with a unique question printed on a corresponding question tab 16 or wherein the unique answer printed on the each corresponding reference card 20 of the reference cards 20 is associated with the unique query printed on a corresponding bonus tab 18. Each reference card 20 of the plurality of reference cards 20 which corresponds to a question tab may have wording in a dark coloration, whereas, the reference cards 20 that have answers that correspond to a bonus tab (these may also be referred to as bonus cards 20) may have text in a red coloration to correspond to the bonus tabs and further indicate that the reference card 20 is a bonus card 20, and gives the answer to a question posed by a bonus tab.

The collection of first award tokens 24 may comprise a plurality of non-golden colored stylized painting brushes.

The collection of second award tokens 26 comprise a plurality of golden colored stylized painting brushes.

The first set of play pieces 22 may comprises a plurality of light colored cups.

The second set of play pieces 22 may comprises a plurality of dark colored cups.

An optional rotating base 40 may be added to the kit 10. The rotating base 40 is attachable to the game board 28.

Another preferred embodiment of the game kit 10 comprises: a bucket 12; a pail 14; a plurality of question tabs 16, wherein each question tab 16 of the plurality of question tabs 16 has a unique question printed on each corresponding question tab 16 of the plurality of question tabs 16; a plurality of bonus tabs 18, wherein each bonus tab 18 of the plurality of bonus tabs 18 has a unique query printed on each corresponding bonus tab 18 of the plurality of bonus tabs 18; a plurality of reference cards 20, wherein each reference card 20 of the reference cards 20 has a unique answer printed on each corresponding reference card 20 of the reference cards 20 in which the unique answer printed on the each corresponding reference card 20 of the reference cards 20 is associated with the unique question printed on the each corresponding question tab 16 of the plurality of question tabs 16 or is a bonus card 20 with an answer associated with the unique query printed on the corresponding bonus tab 18 of the plurality of bonus tabs 18; a first set of play pieces 22; a second set of play pieces 22; a collection of first award tokens 24, the collection of first award tokens 24 comprises a plurality of non-golden colored stylized painting brushes; a collection of second award tokens 26, the collection of second award tokens 26 comprises a plurality of golden colored stylized painting brushes; a checkerboard design like game board 28 having a generally square shape and a playing facade 30, the playing facade 30 of the game board 28 comprising a plurality of dark squares 32 and a plurality of light squares 34, wherein the game board 28 is foldable; the playing facade 30 of the game board 28 comprises a plurality of rows 36 in which each row 36 of the plurality of rows 36 is composed of alternating dark and light squares (32 and 34) of the plurality of dark squares 32 and the plurality of light squares 34, respectively, the playing facade 30 of the game board 28 comprises a plurality of columns 38 in which each column 38 of the plurality of columns 38 is composed of alternating dark and light squares (32 and 34) of the plurality of dark squares 32 and the plurality of light squares 34, respectively, the playing facade 30 of the game board 28 having at least eight rows 36 and eight columns 38, wherein each dark square 32 of the plurality of dark squares 32 having a unique art image affixed on each corresponding dark square 32 of the plurality of dark squares 32; and a rotating base 40 attachable to the game board 28.

One preferred embodiment of the method of using a game kit 10 for learning facts about art subjects, the method comprises the steps of adding, agreeing, attaching, depositing, enlisting, inserting, letting, obtaining, placing, positioning, putting, resolving, mixing, sitting, unfolding, and volunteering. The obtaining step comprises obtaining the game kit 10 comprising: a bucket 12; a pail 14; a plurality of question tabs 16, wherein each question tab 16 of the plurality of question tabs 16 having a unique question printed on each corresponding question tab 16 of the plurality of question tabs 16; a plurality of bonus tabs 18, wherein each bonus tab 18 of the plurality of bonus tabs 18 has a unique query printed on each corresponding bonus tab 18 of the plurality of bonus tabs 18; a plurality of reference cards 20, wherein each reference card 20 of the reference cards 20 has a unique answer printed on each corresponding reference card 20 of the reference cards 20 in which the unique answer printed on the each corresponding reference card 20 of the reference cards 20 is associated with the unique question printed on the each corresponding question tab 16 of the plurality of question tabs 16 or is associated with the unique query printed on the corresponding bonus tab 18 of the plurality of bonus tabs 18; a first set of play pieces 22; a second set of play pieces 22; a collection of first award tokens 24, the collection of first award tokens 24 comprises a plurality of non-golden colored stylized painting brushes; a collection of second award tokens 26, the collection of second award tokens 26 comprises a plurality of golden colored stylized painting brushes; a checkerboard design like game board 28 having a generally square shape and a playing facade 30, the playing facade 30 of the game board 28 comprising a plurality of dark squares 32 and a plurality of light squares 34, wherein the game board 28 is foldable; the playing facade 30 of the game board 28 comprises a plurality of rows 36 in which each row 36 of the plurality of rows 36 is composed of alternating dark and light squares (32 and 34) of the plurality of dark squares 32 and the plurality of light squares 34, respectively, the playing facade 30 of the game board 28 comprises a plurality of columns 38 in which each column 38 of the plurality of columns 38 is composed of alternating dark and light squares (32 and 34) of the plurality of dark squares 32 and the plurality of light squares 34, respectively, the playing facade 30 of the game board 28 having at least eight rows 36 and eight columns 38, wherein each dark square 32 of the plurality of dark squares 32 having a unique art image affixed on each corresponding dark square 32 of the plurality of dark squares 32; and a rotating base 40 attachable to the game board 28. The volunteering step comprises volunteering by a first person to become a first player. The enlisting step comprises enlisting by second person to become a second player. The unfolding step comprises unfolding the game board 28. The attaching step comprises attaching the rotating base 40 to the game board 28. The placing step comprises placing the rotating base 40 attached to the game board 28 onto a tabletop so that the playing facade 30 of the game board 28 faces up. The sitting step comprises sitting down the first and second players so that the first and second players face each other and so that the game board 28 is between the first and second players. The putting step comprises putting the first set of play pieces 22 onto dark squares 32 of the plurality of dark squares 32 of the game board 28 in the first three rows 36 of the game board 28, wherein the first three rows 36 of the game board 28 are the rows 36 of the game board 28 closest to the first player sitting down. The positioning step comprises positioning the second set of play pieces 22 onto dark squares 32 of the plurality of dark squares 32 of the game board 28 in the last three rows 36 on the game board 28, wherein the last three rows 36 of the game board 28 are the rows 36 of the game board 28 closest to the second player sitting down. The mixing step comprises mixing together the question tabs 16 with the bonus tabs 18 to form a set of playing tabs. The depositing step comprises depositing the set of playing tabs into the bucket 12. The inserting step comprises inserting the plurality of first award tokens 24 into the pail 14. The adding step comprises adding the plurality of second award tokens 26 into the pail 14. The agreeing step comprises agreeing on a playing sequence of alternate turns to be allowed between the first and second players. The letting step comprises letting the first and second players to decide on which of the first and second players is to initiate the playing sequence of alternate turns. The resolving step comprises resolving any disputes that may arise by referring to the plurality of reference cards 20.

The method may further comprise the steps of awarding, drawing, giving, moving, reading, and withdrawing. The moving step comprises moving any given play piece 22 of the first set of pieces by the first player onto any diagonally forward unoccupied dark space of the plurality of dark spaces on the playing facade 30 of the game board 28 when the first player is allowed to take a corresponding turn in the playing sequence of alternate turns, wherein the diagonally forward unoccupied dark space of the plurality of dark spaces is forwardly positioned adjacent relative to where the given piece of the first set of pieces was originally at prior to when the first player is allowed to take the corresponding turn in the playing sequence of alternate turns and wherein the diagonally forward unoccupied dark space of the plurality of dark spaces is forward relative to the sitting position of the first player. The drawing step comprises drawing a tab from the set of playing tabs from within the bucket 12 by the first player, wherein the drawn tab is a randomly drawn question tab 16. The reading step comprises reading by the first player the separate corresponding unique question printed on the randomly drawn question tab 16. The withdrawing step comprises withdrawing a tab from the set of playing tabs from within the bucket 12 by the first player, wherein the withdrawn tab is a randomly withdrawn bonus tab 18. The giving step comprises giving to the first player one first award token 24 from within the pail 14, when the first player answers correctly the unique question printed on the randomly drawn question tab 16. The awarding step comprises awarding to the first player one second award token 26 from within the pail 14, when the first player answers correctly the unique query printed on the randomly withdrawn bonus tab 18.

The method may also further comprise the steps of bestowing, comprehending, endowing, pulling, sliding, and taking. The sliding step comprises sliding any given play piece 22 of the second set of pieces by the second player onto any diagonally rearwardly unoccupied dark space of the plurality of dark spaces on the playing facade 30 of the game board 28 when the second player is allowed to take an associated turn in the playing sequence of alternate turns, wherein the diagonally forward unoccupied dark space of the plurality of dark spaces is rearwardly positioned adjacent relative to where the given piece of the first set of pieces was originally at prior to when the second player is allowed to take the associated turn in the playing sequence of alternate turns, and wherein the diagonally forward unoccupied dark space of the plurality of dark spaces is forward relative to the sitting position of the second player. The pulling step comprises pulling a tab from the set of playing tabs from within the bucket 12 by the second player, wherein the pulled tab is a randomly pulled question tab 16. The comprehending step comprises comprehending by the second player the separate corresponding unique question printed on the randomly pulled question tab 16. The taking step comprises taking a tab from the set of playing tabs from within the bucket 12 by the second player, wherein the taken tab is a randomly taken bonus tab 18. The endowing step comprises endowing to the second player one first award token 24 from within the pail 14, when the second player answers correctly the unique question printed on the randomly pulled question tab 16. The bestowing step comprises bestowing to the second player one second award token 26 from within the pail 14, when the second player answers correctly the unique query printed on the randomly taken bonus tab 18.

Referring now to FIG. 1 which depicts a perspective view of a preferred embodiment of the game kit 10 showing a bucket 12; a pail 14; a plurality of question tabs 16 mixed with a plurality of bonus tabs 18, two stacks of a plurality of reference cards 20; a first set of play pieces 22; a second set of play pieces 22; a collection of first award tokens 24 mixed with a collection of second award tokens 26; and a checkerboard design like game board 28. The checkerboard design like game board 28 having a generally square shape and a playing facade 30, in which the playing facade 30 of the game board 28 comprising a plurality of dark squares 32 and a plurality of light squares 34. The playing facade 30 of the game board 28 comprises a plurality of rows 36 in which each row 36 of the plurality of rows 36 is composed of alternating dark and light squares (32 and 34) of the plurality of dark squares 32 and the plurality of light squares 34, respectively. The playing facade 30 of the game board 28 comprises a plurality of columns 38 in which each column 38 of the plurality of columns 38 is composed of alternating dark and light squares (32 and 34) of the plurality of dark squares 32 and the plurality of light squares 34, respectively. The playing facade 30 of the game board 28 having at least eight rows 36 and eight columns 38. Each dark square 32 of the plurality of dark squares 32 having a unique art image affixed on each corresponding dark square 32 of the plurality of dark squares 32.

Referring now to FIG. 2 which depicts a closeup view of a section of a facade of the game board of preferred embodiment of the game kit showing each dark square 32 of the plurality of dark squares 32 has a unique art image affixed on each corresponding dark square 32 of the plurality of dark squares 32.

Figure 3:
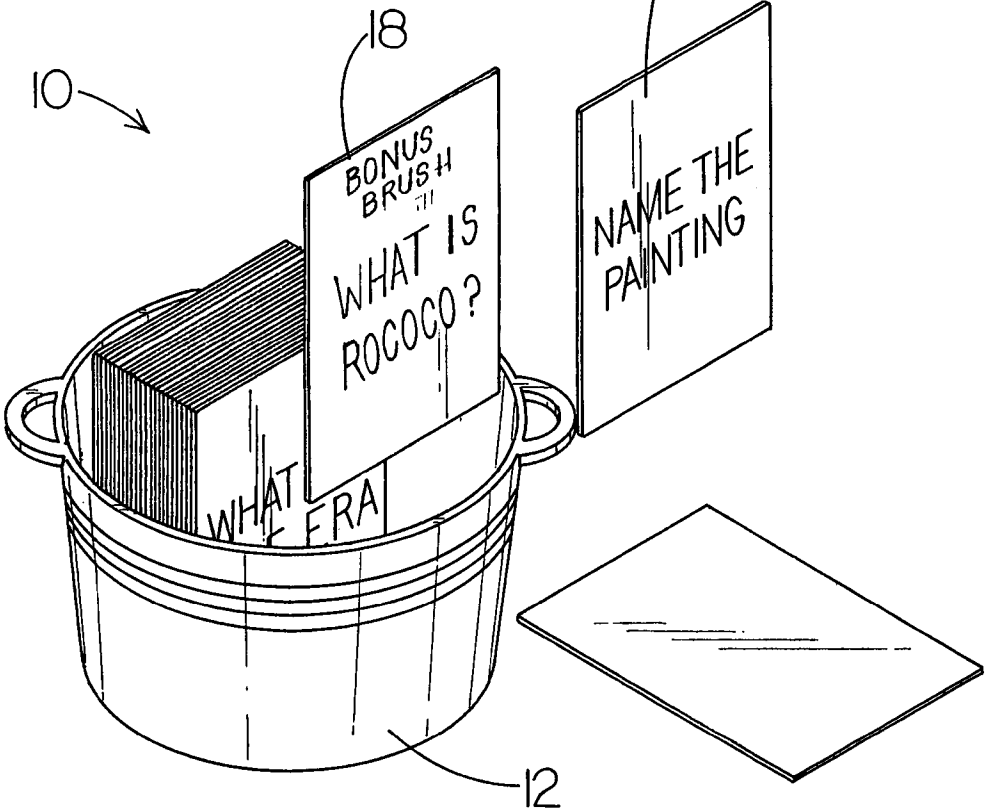
FIG. 3 is a perspective view of some of the elements of a preferred embodiment of the game kit of the present invention.

Referring now to FIG. 3 which depicts a perspective view of some of the elements of a preferred embodiment of the game kit showing the plurality of question tabs 16 mixed with the plurality of bonus tabs 18 placed in the bucket 12.

Figure 4:
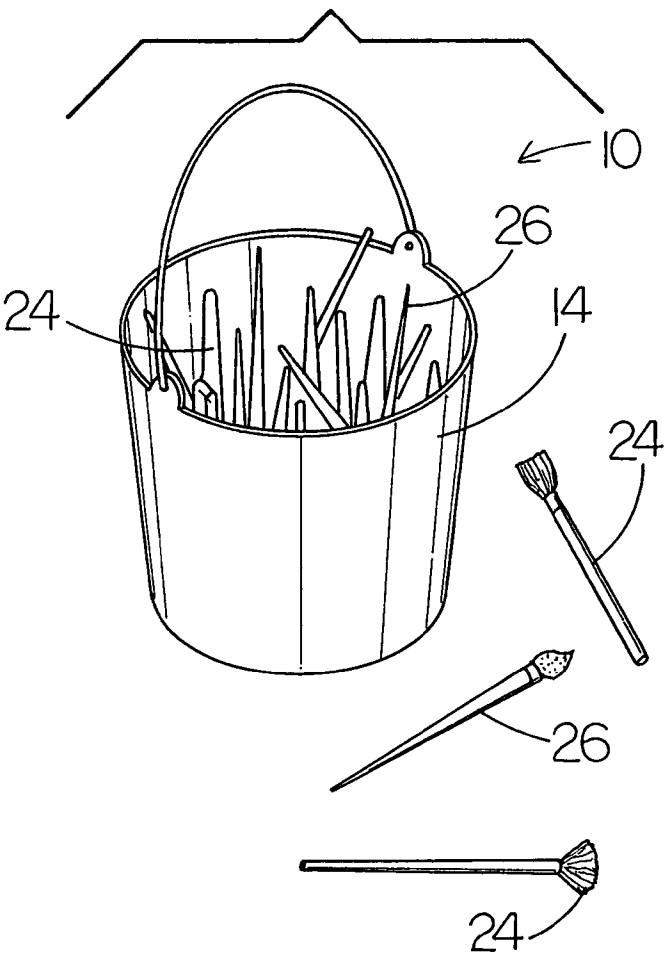
FIG. 4 is a perspective view of some of the elements of a preferred embodiment of the game kit of the present invention.

Referring now to FIG. 4 which depicts a perspective view of some of the elements of a preferred embodiment of the game kit showing the collection of first award tokens 24 mixed with a collection of second award tokens 26 and placed in the pail 14. The collection of first award tokens 24 is shown comprising a plurality of non-golden colored stylized painting brushes. The collection of second award tokens 26 is shown comprising a plurality of golden colored stylized painting brushes.

Figure 5:
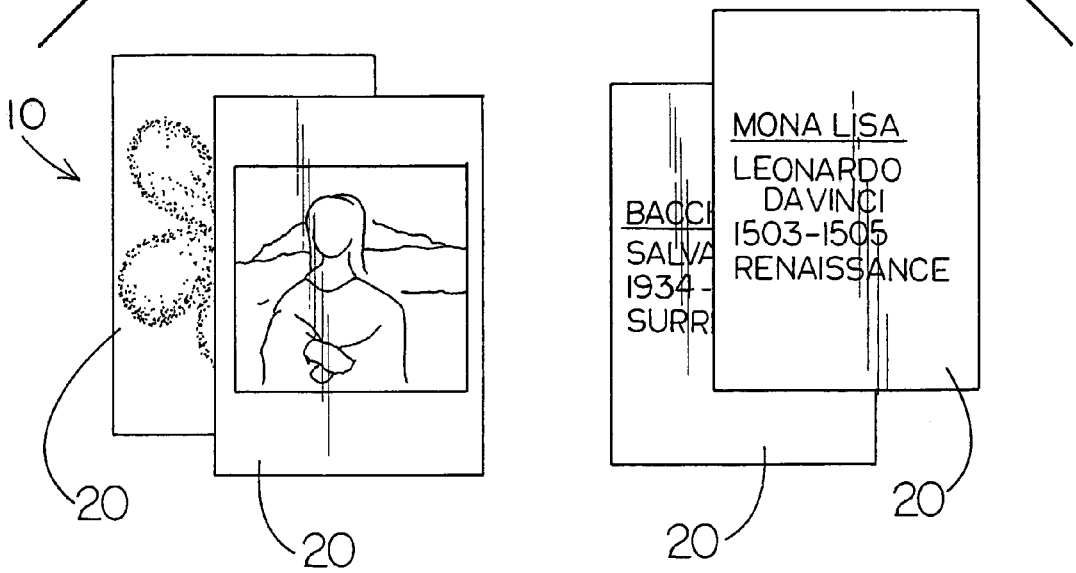
FIG. 5 is a front and back view of some of the reference cards of a preferred embodiment of the game kit of the present invention.

Referring now to FIG. 5, which depicts front and back closeup views of some of the reference cards of a preferred embodiment of the game kit 10.

Figure 6:
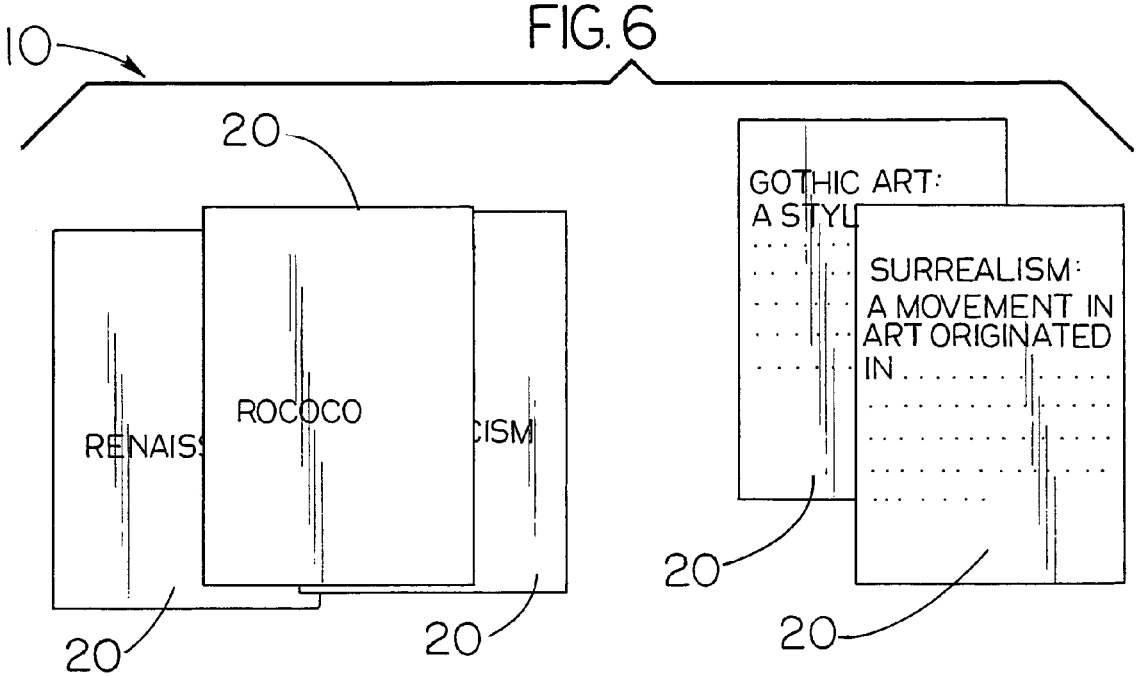
FIG. 6 is a front and back view of some of the reference cards of a preferred embodiment of the game kit of the present invention.

Referring now to FIG. 6, which depicts a front and back closeup view of some of the bonus cards of a preferred embodiment of the game kit 10.

Figure 7:
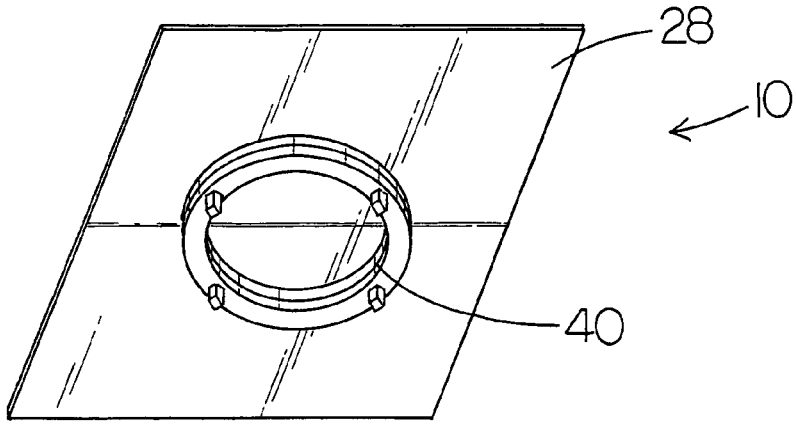
FIG. 7 is a bottom perspective view of a preferred embodiment of the game kit of the present invention.

Referring now to FIG. 7, which depicts a bottom perspective view of a preferred embodiment of the game kit 10 showing the bottom of the game board 28 attached to the rotating base 40.

As to the manner of usage and operation of the present invention, the same should be apparent from the above description. Accordingly, no further discussion relating to the manner of usage and operation will be provided.

While a preferred embodiment of the game kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while question tabs have text in a dark color, bonus tabs have text in red, and reference cards have answers in text that correspond to the text color of the tab to which they correspond, any contrasting set of colors can be used without deviating from the spirit and scope of the invention. Similarly, the tabs may constitute cards, and the brushes may be other figurines or objects.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the them "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combination any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method of using a game kit for learning facts about art subjects, said method comprising:

obtaining the game kit comprising:

a bucket;

a pail;

a plurality of question tabs, wherein each question tab of the plurality of question tabs has a question about art subjects printed on each corresponding question tab of the plurality of question tabs, wherein each question appears on only one question tab;

a plurality of bonus tabs, wherein each bonus tab of the plurality of bonus tabs has a query about art subjects printed on each corresponding bonus tab of the plurality of bonus tabs, wherein each question appears on only one bonus tab;

a plurality of reference cards, wherein each reference card of said reference cards has an answer printed on each corresponding reference card of said reference cards in which the answer printed on said each corresponding reference card of said reference cards is associated with the set of said questions printed on said each corresponding question tab of said plurality of question tabs and said queries printed on said corresponding bonus tab of said plurality of bonus tabs;

a first set of play pieces;

a second set of play pieces;

a collection of first award tokens, the collection of first award tokens comprises a plurality of non-golden colored stylized painting brushes;

a collection of second award tokens, the collection of second award tokens comprises a plurality of golden colored stylized painting brushes;

a checkerboard design like game board having a generally square shape and a playing facade, the playing facade of the game board comprising a plurality of dark squares and a plurality of light squares, wherein the playing facade of the game board comprises a plurality of rows in which each row of the plurality of rows is composed of alternating dark and light squares of the plurality of dark squares and the plurality of light squares, respectively, the playing facade of the game board comprises a plurality of columns in which each column of the plurality of columns is composed of alternating dark and light squares of the plurality of dark squares and the plurality of light squares, respectively, the playing facade of the game board having at least eight rows and eight columns, wherein each dark square of the plurality of dark squares having a unique art image affixed on each corresponding dark square of the plurality of dark squares; and a rotating base attachable to the game board;

volunteering by a first person to become a first player;

enlisting by second person to become a second player;

unfolding the game board;

attaching the rotating base to the game board;

placing the rotating base attached to the game board onto a table top so that the playing facade of the game board faces up;

sitting down the first and second players so that the first and second players face each other and so that the game board is between the first and second players;

putting the first set of play pieces onto dark squares of the plurality of dark squares of the game board in the first three rows of the game board, wherein the first three rows of the game board are the rows of the game board closest to the first player sitting down;

positioning the second set of play pieces onto dark squares of the plurality of dark squares of the game board in the last three rows on the game board, wherein the last three rows of the game board are the rows of the game board closest to the second player sitting down;

mixing together the question tabs with the bonus tabs to form a set of playing tabs;

depositing the playing tabs into the bucket;

inserting the plurality of first award tokens into the pail;

adding the plurality of second award tokens into the pail;

agreeing on a playing sequence of alternate turns to be allowed between the first and second players;

letting the first and second players to decide on which of the first and second players is to initiate the playing sequence of alternate turns;

moving any given play piece of the first set of pieces by the first player onto any diagonally forward unoccupied dark space of the plurality of dark spaces on the playing facade of the game board when the first player is allowed to take a corresponding turn in the playing sequence of alternate turns, wherein the diagonally forward unoccupied dark space of the plurality of dark spaces is forwardly positioned adjacent relative to where the given piece of the first set of pieces was originally at prior to when the first player is allowed to take the corresponding turn in the playing sequence of alternate turns and wherein the diagonally forward unoccupied dark space of the plurality of dark spaces is forward relative to the sitting position of the first player;

responsive to moving said play piece to a diagonally forward unoccupied dark space having a unique art image affixed thereupon, drawing a tab from the set of playing tabs from within the bucket by the first player, wherein the drawn tab is randomly drawn from the set comprising question tabs and bonus tabs;

responsive to drawing a question tab, reading by the first player the separate corresponding question printed on the randomly drawn question tab;

responsive to drawing a bonus tab, reading by the first player the separate corresponding query printed on the randomly withdrawn bonus tab;

referring to the plurality of reference cards to determine if an answer given by the first player to the question or query is correct;

giving to the first player one first award token from within the pail, when the first player answers correctly the question printed on the randomly drawn question tab; and awarding to the first player one second award token from within the pail, when the first player answers correctly the query printed on the randomly withdrawn bonus tab.

2. The method of claim 1 further comprising:

sliding any given play piece of the second set of pieces by the second player onto any diagonally rearwardly unoccupied dark space of the plurality of dark spaces on the playing facade of the game board when the second player is allowed to take an associated turn in the playing sequence of alternate turns, wherein the diagonally forward unoccupied dark space of the plurality of dark spaces is rearwardly positioned adjacent relative to where the given piece of the first set of pieces was originally at prior to when the second player is allowed to take the associated turn in the playing sequence of alternate turns, and wherein the diagonally forward unoccupied dark space of the plurality of dark spaces is forward relative to the sitting position of the second player;

responsive to moving said play piece to a diagonally rearward unoccupied dark space having a unique art image affixed thereupon pulling a tab from the playing tabs from within the bucket by the second player;

responsive to pulling a question tab, comprehending by the second player the separate corresponding question printed on the randomly pulled question tab;

responsive to pulling a bonus tab, comprehending by the second player the separate corresponding query printed on the randomly pulled bonus tab;

referring to the plurality of reference cards to determine if an answer given by the second player to the question or query is correct;

endowing to the second player one first award token from within the pail, when the second player answers correctly the question printed on the randomly pulled question tab; and bestowing to the second player one second award token from within the pail, when the second player answers correctly the query printed on the randomly taken bonus tab.

* * * * *